US008646730B2

(12) United States Patent
Guglielmo et al.

(10) Patent No.: US 8,646,730 B2
(45) Date of Patent: Feb. 11, 2014

(54) HYDRAULIC OIL CONTROL UNIT FOR SUPPLYING HYDRAULIC OIL ACTUATORS IN SWITCH MACHINES OF RAILWAY POINTS

(75) Inventors: Davide Guglielmo, Bologna (IT); Giuliano Luzzi, Osteria Grande-Castel San Pietro Terme (IT); Stefano Bittoni, Bologna (IT)

(73) Assignee: Alstom Transport SA, Levallois-Perret (FR)

( * ) Notice: Subject to any disclaimer, the term of this patent is extended or adjusted under 35 U.S.C. 154(b) by 0 days.

(21) Appl. No.: 13/184,299

(22) Filed: Jul. 15, 2011

(65) Prior Publication Data

US 2012/0018592 A1 Jan. 26, 2012

(30) Foreign Application Priority Data

Jul. 22, 2010 (EP) ..... 10425249

(51) Int. Cl.
*B61L 5/04* (2006.01)

(52) U.S. Cl.
USPC ..... 246/258

(58) Field of Classification Search
USPC ..... 246/131, 139, 140, 257, 258, 220, 253, 246/260, 263
See application file for complete search history.

(56) References Cited

U.S. PATENT DOCUMENTS

| | | | | |
|---|---|---|---|---|
| 1,789,621 | A * | 1/1931 | Eppley | 246/257 |
| 4,213,588 | A * | 7/1980 | Bowles | 246/259 |
| 4,452,188 | A * | 6/1984 | Kosuda et al. | 123/90.18 |
| 5,292,091 | A * | 3/1994 | Callegari et al. | 246/258 |
| 5,687,935 | A * | 11/1997 | Durchschlag et al. | 246/257 |
| 6,056,244 | A * | 5/2000 | Durchschlag et al. | 246/257 |
| 7,150,436 | B2 * | 12/2006 | Achleitner et al. | 246/415 R |
| 2008/0251649 | A1 * | 10/2008 | Salmans | 246/415 R |

FOREIGN PATENT DOCUMENTS

| | | |
|---|---|---|
| DE | 1952824 | 5/1971 |
| DE | 3227203 | 3/1983 |
| EP | 712772 | 5/1996 |
| FR | 2066310 | 6/1971 |
| GB | 296400 | 10/1929 |
| WO | 00/73119 | 12/2000 |

OTHER PUBLICATIONS

EP Search Report mailed on Mar. 4, 2011 for EP10425249.9 filed Jul. 22, 2010 in the name of Alstom Transport SA.
EP Search Opinion mailed on Mar. 4, 2011 for EP10425249.9 filed Jul. 22, 2010 in the name of Alstom Transport SA.
Hartl, F. et al., Signal + Draht, Telzlaff Verlag GMBH, 1985, 77: 188-194 (English translation of the abstract).

* cited by examiner

*Primary Examiner* — R. J. McCarry, Jr.
*Assistant Examiner* — Jean Charleston
(74) *Attorney, Agent, or Firm* — Steinfl & Bruno, LLP

(57) ABSTRACT

A hydraulic oil control unit for supplying hydraulic oil actuators in switch machines of railway points or the like is described. The control unit comprises a closed circulation circuit of a hydraulic oil fluid with delivery and return lines. These lines are connected to a hydraulic oil actuator translating point blades of the railway point for moving the point blades from a normal end position to a reverse end position or vice versa. The control unit also includes: electrical means for monitoring the movement of the point blades and/or reaching of the end position, timing means for stopping an actuating stroke of actuators moving the point blades, and means for switching the direction of the actuating stroke. The electrical means comprise switches reversing the power supply signal of an electric motor driving the pump for reversing the rotational direction of the motor and the pump. The switches are driven when the point blades reach a proper end position to reverse the circulation direction of the hydraulic oil fluid flow in the circulation circuit.

18 Claims, 5 Drawing Sheets

HYDRAULIC OIL CONTROL UNIT FOR SUPPLYING HYDRAULIC OIL ACTUATORS IN SWITCH MACHINES OF RAILWAY POINTS

CROSS REFERENCE TO RELATED APPLICATIONS

The present application claims priority to European patent application EP 10425249.9 filed on Jul. 22, 2010, which is incorporated herein by reference in its entirety.

FIELD

The present disclosure relates to a hydraulic oil control unit for supplying hydraulic oil actuators in switch machines of railway points or the like. The control unit comprises a closed circulation circuit for a hydraulic oil fluid, wherein at least one circulation pump with a delivery end and an intake end connected to a delivery line and a return line respectively of the circulation circuit of the fluid is provided. The delivery and return lines of the circulation circuit are connected to at least one hydraulic oil actuator translating the point blades of the railway point, for moving the point blades from one position to the other one of two end positions, called normal and reverse.

Electrical means are provided for functionally monitoring the movement of the point blades and/or providing that the end position the point blades have been moved to has been reached.

Timing means are provided for stopping the actuating stroke of actuators moving the point blades when one of the end positions has been reached and/or after a predetermined operating time of the actuators moving the point blades.

Means for switching the direction of the actuating stroke are provided, by reversing the circulation direction of the hydraulic oil fluid to the actuator translating point blades, for operating the actuator in the opposite direction.

Control units for railway points are known and widely used. Movement of the point blades of a railway point causes one of the two point blades to be alternately moved in a position approaching the rail provided on the same longitudinal side of the railway line of the corresponding point blade, while the opposite point blade is moved in a position away from the corresponding rail. The operations and the positions of the point blades resulting there from, are conventionally called normal and reverse, since the railway point operates to deviate the train route from a specific path.

BACKGROUND

Hydraulic oil actuators for moving the point blades are known.

A double-acting linear actuator or two linear actuators which are independent and operate oppositely each other are connected to the delivery lines of a hydraulic oil circuit. The hydraulic oil fluid is supplied to the actuators by an electric motor driven pump, which takes the fluid from a reservoir or causes the fluid to flow in a closed circuit with a delivery line and a return line.

In order to achieve the movement from the normal position to the reverse position and vice versa in the supply circuit, valves are provided which are electrically operated and can be switched to connect the delivery end of the circulation pump (i.e., the delivery line of the circuit) in a first condition to the inlet of one of the two actuators (or to one of the two inlets of a double-acting actuator) and in a second condition to the inlet of the other one of the two actuators (or to the other inlet of a double-acting actuator). At the same time, the actuator not supplied by the fluid (or the inlet of the double-acting cylinder not connected to the delivery line) is connected to the intake end of the circulation pump by the return line of the circulation circuit.

A hydraulic oil fluid reservoir draws the fluid and fills the closed circuit, or gathers the hydraulic oil fluid discharged from one or more outlets of the circuit.

The length of time during which the fluid is supplied to the actuators is determined by electrical means such as pressure sensors and/or electric timers or valves or combinations of such means.

In addition to the fact that the construction of the control unit is made more complex and expensive, known solutions providing electrical means for switching the movement direction of the point blades and timing electrical means are relatively unsafe with reference to the high standards required in the railway field and in similar fields.

SUMMARY

According to a first aspect, a control unit of the type described hereinbefore is provided. The control unit is a hydraulic oil control unit for supplying hydraulic oil actuators in switch machines of railway points or the like. The control unit comprises a closed circulation circuit for a hydraulic oil fluid, wherein at least one circulation pump is provided, with a delivery end and an intake end connected to a delivery line and a return line respectively of the circulation circuit of said fluid. The delivery and return lines of the circulation circuit are connected to at least one hydraulic oil actuator, in order to translate the point blades, by moving said point blades from a normal end position to a reverse end position or vice versa, the control unit further comprising electrical means for functionally monitoring the movement of the point blades and/or monitoring reaching the end position the point blades have been moved to;

timing means for stopping an actuating stroke of actuators moving the point blades when one of the end positions has been reached and/or after a predetermined operating time of said actuators, and means for switching a direction of the actuating stroke, by reversing a circulation direction of the hydraulic oil fluid to the actuator translating the point blades in order to operate the actuator in the opposite direction, wherein the circulation pump is a reversible circulation pump, the electrical means switching the direction of the actuating stroke comprise switches reversing a power supply signal of an electric motor driving the pump in order to reverse a rotational direction of said motor and of said pump, the electrical means being driven when the point blades reach the end position, to generate said reversing of the circulation direction of the hydraulic oil fluid flow in the circulation circuit.

According to a further aspect that can be provided in addition or in alternative to the one described above, the present disclosure provides a hydraulic oil control unit for supplying hydraulic oil actuators in switch machines of railway points or the like. The control unit comprises a closed circulation circuit for a hydraulic oil fluid, wherein at least one circulation pump is provided, with a delivery end and an intake end connected to a delivery line and a return line respectively of the circulation circuit of said fluid. The delivery and return lines of the circulation circuit are connected to at least one hydraulic oil actuator, in order to translate the point blades of the point, for moving said point blades from a normal end position to a reverse end position or vice versa, the control unit further comprising electrical means for functionally monitoring the movement of the point blades and/or monitoring reaching the end position the point blades have been moved to;

timing means for stopping an actuating stroke of actuators moving the point blades when one of the end positions has been reached and/or after a predetermined operating time of said actuators, and means for switching a direction of the actuating stroke, by reversing a circulation direction of the hydraulic oil fluid to the actuator translating the point blades in order to operate the actuator in the opposite direction, wherein the timing means are hydraulic means detecting changes in flow parameters in the circulation circuit and, on the basis of said changes, they operate at least electrical switches breaking the power supply of a motor driving the pump and/or operate said means for switching a direction of the actuating stroke of the point blades and/or the means for functionally monitoring the movement of the point blades and/or for monitoring reaching the end position the point blades have been moved to.

According to the above aspect, the timing means are hydraulic means detecting changes in flow parameters in the hydraulic circuit. On the basis of such changes, the timing means control the electrical switches breaking the power supply of a motor driving the pump. Alternatively or in combination the said timing means also operate said means for switching a direction of the actuating stroke of the point blades and/or the means for functionally monitoring the movement of the point blades and/or for monitoring reaching the end position the point blades have been moved to i.e the fact that the blades have reached the proper end position of the corresponding displacement.

In one embodiment, the timing means control the breaking of the power supply to the electric motor of the pump and the circuit monitoring the position of the point blades on the basis of the amount of hydraulic oil fluid supplied by the pump to a timing cylinder/piston assembly.

According to a further embodiment, the hydraulic oil fluid is supplied to the timing cylinder/piston assembly through a valve allowing the fluid passage when it reaches a certain pressure.

In one example, the timing cylinder/piston assembly is connected by branches to at least the delivery line of the hydraulic oil circulation circuit for supplying the linear actuator moving the point blades. The timing cylinder/piston assembly is connected to mechanical means controlling electrical switches constituting the electrical means for functionally monitoring the movement of the point blades and/or the fact they have reached the end position, as well as to electrical means for switching the movement direction of point blades and to electrical means breaking the power supply circuit of the motor of the pump.

The timing cylinder can be a double-acting timing cylinder, where one of the delivery and return lines of the hydraulic oil circulation circuit supplies the linear actuator moving the point blades being connected thereto respectively, that is one of the intake/delivery ports of the pump.

In this case, each inlet/outlet of the timing cylinder/piston assembly is connected to the corresponding delivery and return line of the circulation circuit supplying the hydraulic oil fluid by means of an automatic valve with a shutter movable in the opened condition by the hydraulic oil fluid pressure.

According to a further aspect of the disclosure, the timing cylinder/piston assembly can be mechanically connected, directly or by a transmission, to a mechanical control member switching the electrical contacts.

At least part of the electrical contacts is provided in circuits generating signals monitoring the functional condition and the fact that point blades have properly reached the end position and at least a part of the electrical contacts is part of a circuit supplying/reversing the power supply signal of the motor.

In order to match or adjust the length of the interval of time of the operation of actuators moving the point blades with reference to specific requirements, means for changing the intervals of time of the operation of actuators moving the point blades can be provided inside the control unit.

According to a further embodiment, the timing cylinder/piston assembly can be mechanically connected by a transmission to a mechanical control member switching the electrical contacts, said transmission having an adjustable inlet stroke to outlet stroke ratio.

According to another embodiment that can be provided in combination with the previous embodiment, the control unit comprises flow rate regulators in the branches connecting the delivery and return lines of the hydraulic oil circulation circuit supplying the actuator moving the point blades to the timing cylinder/piston assembly, which regulators have a variable flow rate.

Moreover, in order to keep the actuators and the circuit safe from mulfunctions that can cause pressure of the hydraulic oil fluid to increase in a potentially harmful way, the control unit can also comprise automatic pressure relief valves for the hydraulic oil fluid when the hydraulic oil fluid reaches a predetermined maximum pressure.

According to another embodiment that can be provided in combination with one or more of the above characteristics, the hydraulic oil fluid circulation circuit comprises at least one additional delivery line and at least one corresponding additional return line for controlling an additional switching actuator.

Such actuator can be an intermediate switching actuator like those denoted by 2 in FIG. 1 or a frog switching actuator like those denoted by 3, 3' in FIG. 1.

Similarly to what mentioned above, the actuator can be a double-acting actuator or can comprise a pair of linear actuators working oppositely each other.

According to another embodiment, pressure limiting devices provide a different pressure of the circulation fluid in each additional pair of delivery and return lines, which pressure is intended for controlling the actuator connected thereto with respect to the pressure of the first pair of delivery and return lines.

Such feature can be provided separately from the previously presented features. Therefore, a hydraulic oil control unit for supplying hydraulic oil actuators in switch machines of railway points or the like is further provided, which control unit comprises a closed circulation circuit for a hydraulic oil fluid, wherein at least one circulation pump is provided, with a delivery end and an intake end connected to a delivery line and a return line respectively of the circulation circuit of said fluid. The delivery and return lines of the circulation circuit are connected to at least one hydraulic oil actuator, in order to translate the point blades of the railway point, by moving said point blades from a normal end position to a reverse end position or vice versa, the control unit comprising:

at least one additional delivery line and at least one corresponding additional return line for controlling an additional switching actuator.

These features can be provided in combination with any further features listed above and especially with electrical means for functionally monitoring the movement of the point blades and/or monitoring reaching the end position the point blades have been moved to;

timing means for stopping an actuating stroke of actuators moving the point blades when one of the end positions has been reached and/or after a predetermined operating time of said actuators, and means for switching a direction of the actuating stroke, by reversing a circulation direction of the hydraulic oil fluid to the actuator translating the point blades in order to operate the actuator in the opposite direction.

Further embodiments of the disclosure relate to a method for controlling a hydraulic oil system moving point blades in a railway point or the like for moving said point blades between a normal end position and a reverse end position or vice versa, comprising setting a predetermined interval of time for moving the point blades from the normal end position to the reverse end position or vice versa;

operating hydraulic oil means moving the point blades by supplying a pressurized hydraulic oil fluid for moving the point blades from the normal end position to the reverse end position or vice versa;

measuring the interval of time during which the pressurized hydraulic oil fluid is supplied at a set pressure level for moving the point blades;

stopping supply of the pressurized hydraulic oil fluid when the length of time of the measured interval of time is equal to that of the predetermined interval of time;

and preparing the hydraulic oil fluid supplying circuit to reverse the direction of the hydraulic oil fluid flow for operating hydraulic oil means moving the point blades in the reverse direction, to move the point blades in a reverse manner;

and wherein the interval of time during which the pressurized hydraulic oil fluid is supplied at a set pressure level is hydraulically measured by detecting the volume of the hydraulic oil fluid supplied by the pump.

The volume of the fluid moved in the supply circuit can be detected by a unit transforming the change in the hydraulic oil fluid volume into a mechanical motion controlling switching means/switches stopping and/or reversing the supply of the pressurized hydraulic oil fluid flow.

With respect to the charging of the closed circuit according to one or more of the previous combinations and embodiments and with respect to the storage of the fluid possibly discharged from the closed circuit when maximum pressures provided by relief valves are exceeded, a hydraulic oil fluid reservoir is provided, which takes the fluid and charges the closed circuit, or stores the hydraulic oil fluid discharged from one or more ports of the circuit.

BRIEF DESCRIPTION OF THE DRAWINGS

Further features of the disclosure will be clear from the following description of embodiments shown in the annexed drawings, wherein.

DETAILED DESCRIPTION

A hydraulic control unit for supplying switch machines of point blades of railway points or the like is described. The switch machine is provided with hydraulic oil actuating means controlling the movement of the point blades and receiving the pressurized oil from the hydraulic control unit.

Figure 1:
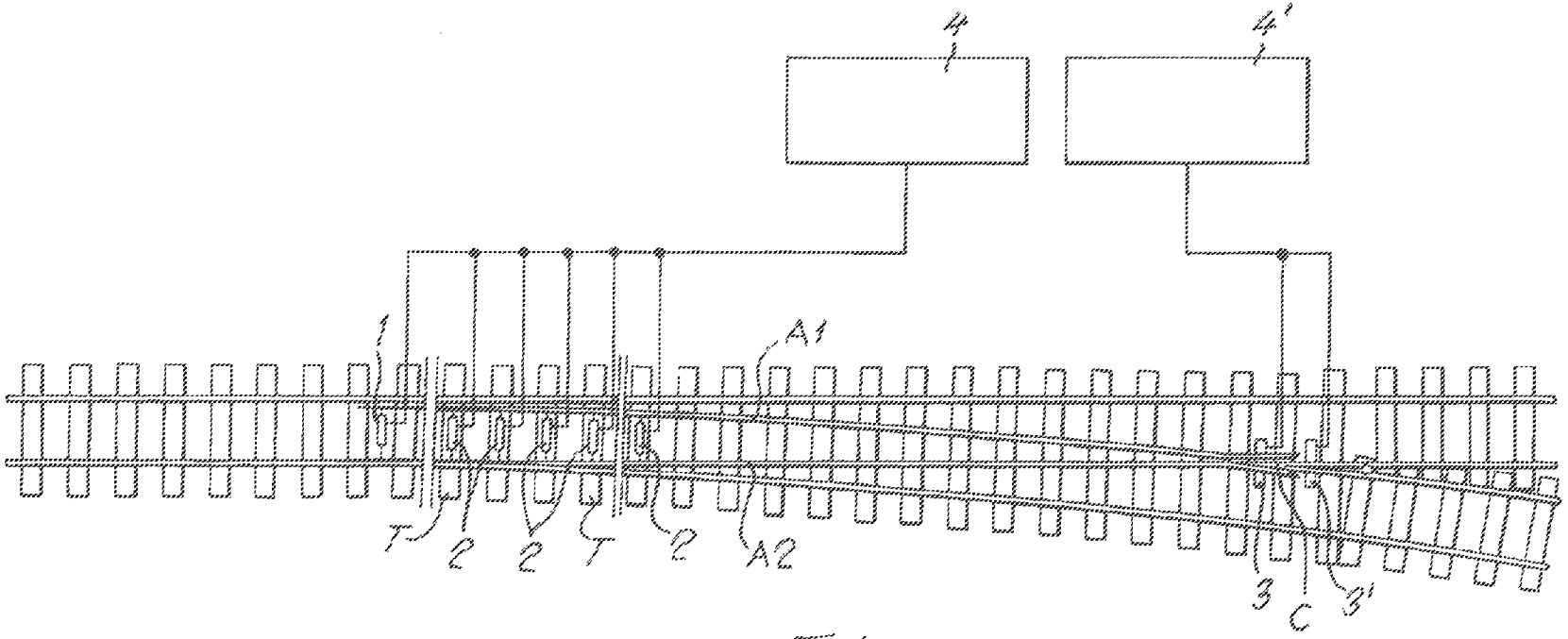
FIG. 1 is an example of a railway point comprising a plurality of switch machines each one provided with actuators for moving point blades. The switch machines are arranged lenghtwise throughout the point blades and in the frog area. The actuators are hydraulic oil actuators fed by hydraulic control units.

FIG. 1 shows an example of such railway point. The point shown is used for high speed lines, where the point blades have a considerable length and where the movement of the point blades is controlled by several switch machines, that is by several actuators arranged throughout the length of the point blades and in the frog area thereof.

The person skilled in the art will understand that the present disclosure is not limited to switch machines for this type of points, but can be applied also to conventional points where a single switch machine is provided, that is one actuator in only one position with respect to point blades, generally at the end portions thereof.

A1 and A2 denote the point blades of the railway point. Reference numbers 1, 2, 3, 3' denote hydraulic oil actuators and T denotes sleepers between tracks. The frog of the points is denoted by C, while the supply hydraulic control units are denoted by 4, 4'.

The command for performing the operation moving the point blades is sent from a control cabinet and upon the reception thereof the control unit 4, 4' begins to supply the actuators for performing the moving stroke of the point blades A1, A2.

Point blades A1 and A2 can be moved together one with respect to the other between two extreme positions. FIG. 1 shows the so-called normal position, where point blade A2 is in contact with the rail directly adjacent to such point blade A2, while the point blade A1 is spaced apart from the rail adjacent thereto. The train keeps a straight travel.

On the other hand, in the so-called reverse position, point blade A1 is in a position adhering to the associated rail and point blade A2 is spaced apart from the rail adjacent thereto. In this case a train would be diverged from the straight direction into the branch towards the bottom of the sheet.

As generally provided with prior art points, switch machines are provided with sensors by means of which it is possible to verify that point blades have reached the proper normal or reverse position at the end of each operation moving the point blades. In such case the sensors are monitoring contacts closing monitoring circuits by means of which monitoring signals are generated which are transmitted or read by cabinets which send commands for performing points operations.

Figure 2:
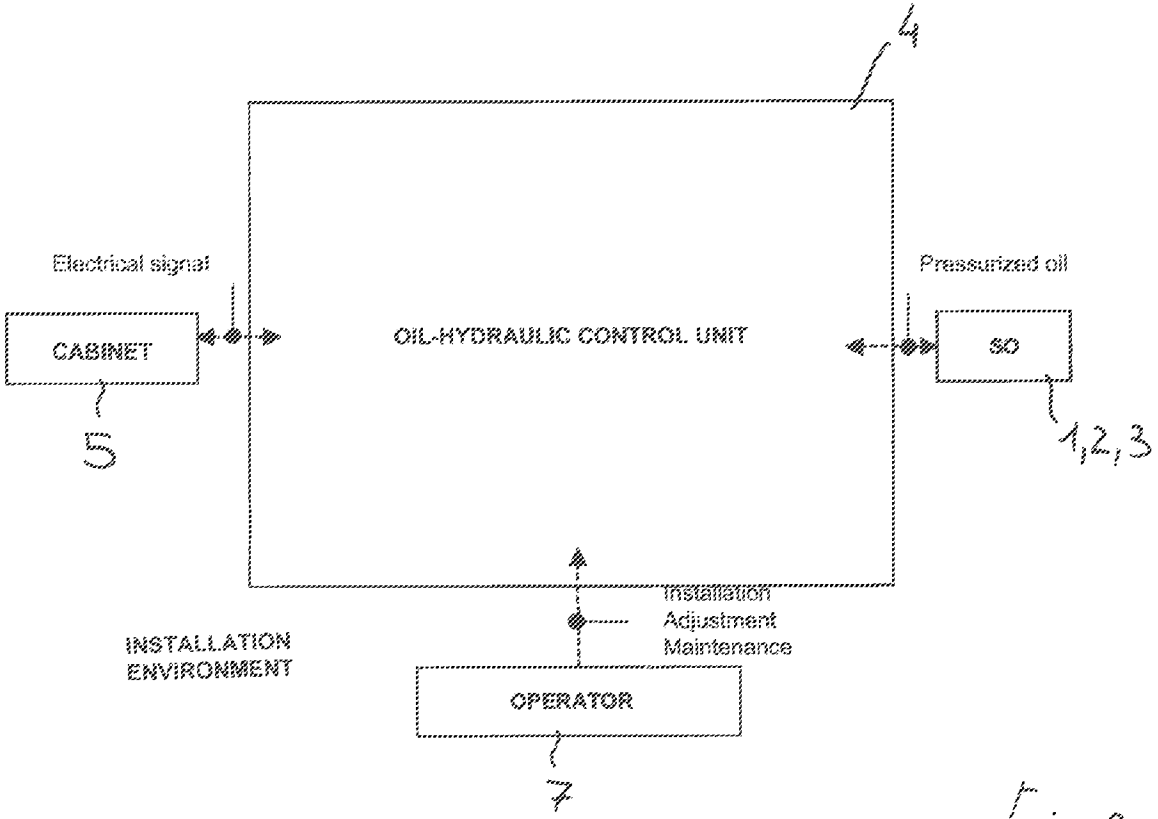
FIG. 2 is a functional block diagram of a hydraulic control unit feeding the hydraulic oil actuators of a railway point.

FIG. 2 shows a functional diagram of one of the control units 4, 4' of FIG. 1. Cabinet 5 generates and sends a control signal switching the points for moving the point blades in a predetermined position (normal or reverse).

The hydraulic oil control unit 4 is operated and supplies pressurized oil to hydraulic oil actuating means 1, 2 or 3. Point blades A1 and A2 are moved. When the moving stroke ends once the normal or reverse end position is reached, the supplying action is stopped and monitoring signals are generated and sent to indicate that the point blades have reached the proper position.

The control unit 4 is also provided with operator interfaces denoted by 7, by means of which the operator can perform adjustments, monitoring and maintenance operations and—should that be possible—manually operate means generating and supplying the pressurized hydraulic oil fluid, such as a manual pump and or the like.

Figure 3A:
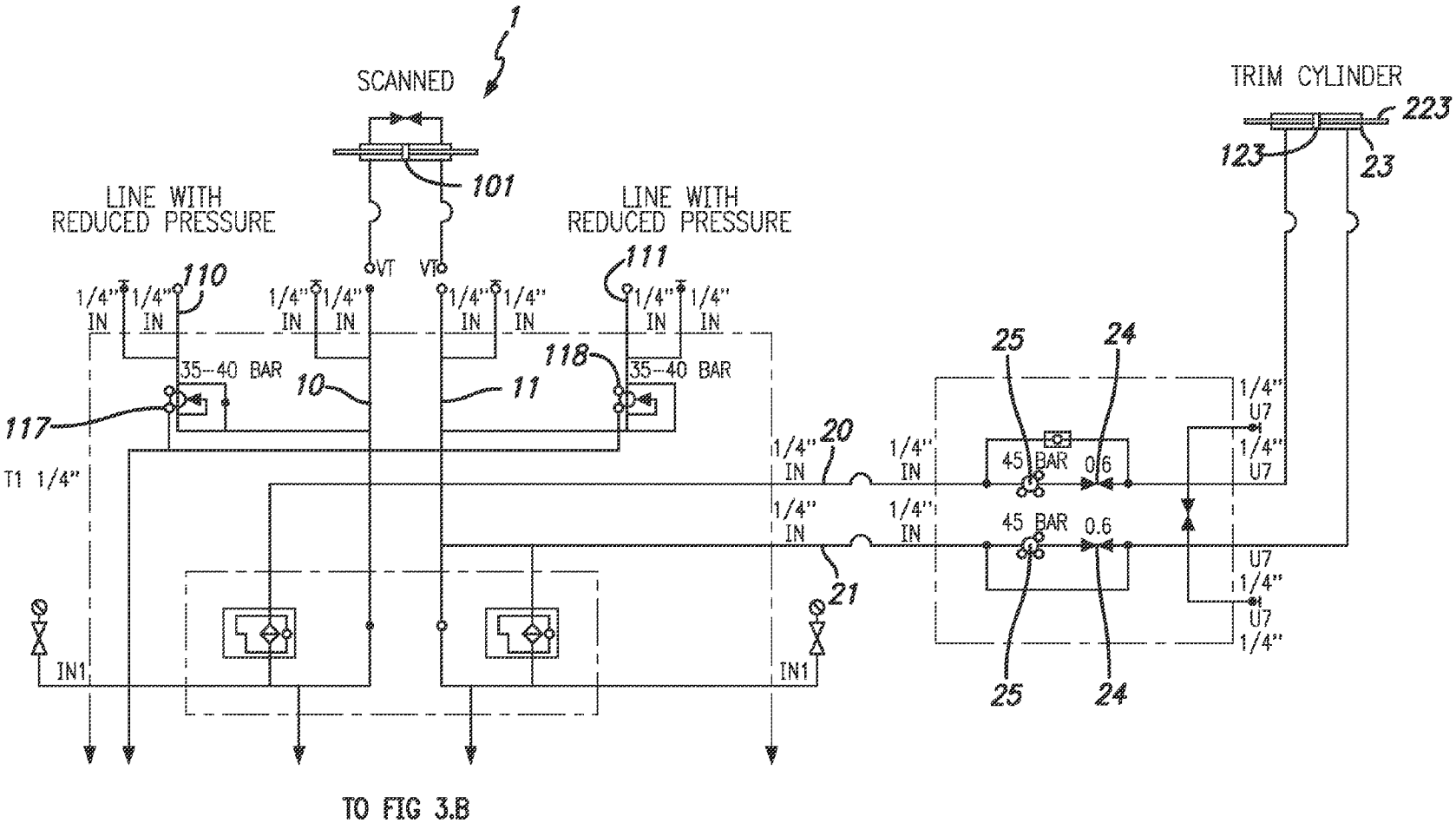
FIGS. 3A-3B show a circuit diagram of the control unit according to FIG. 2.
Figure 3B:
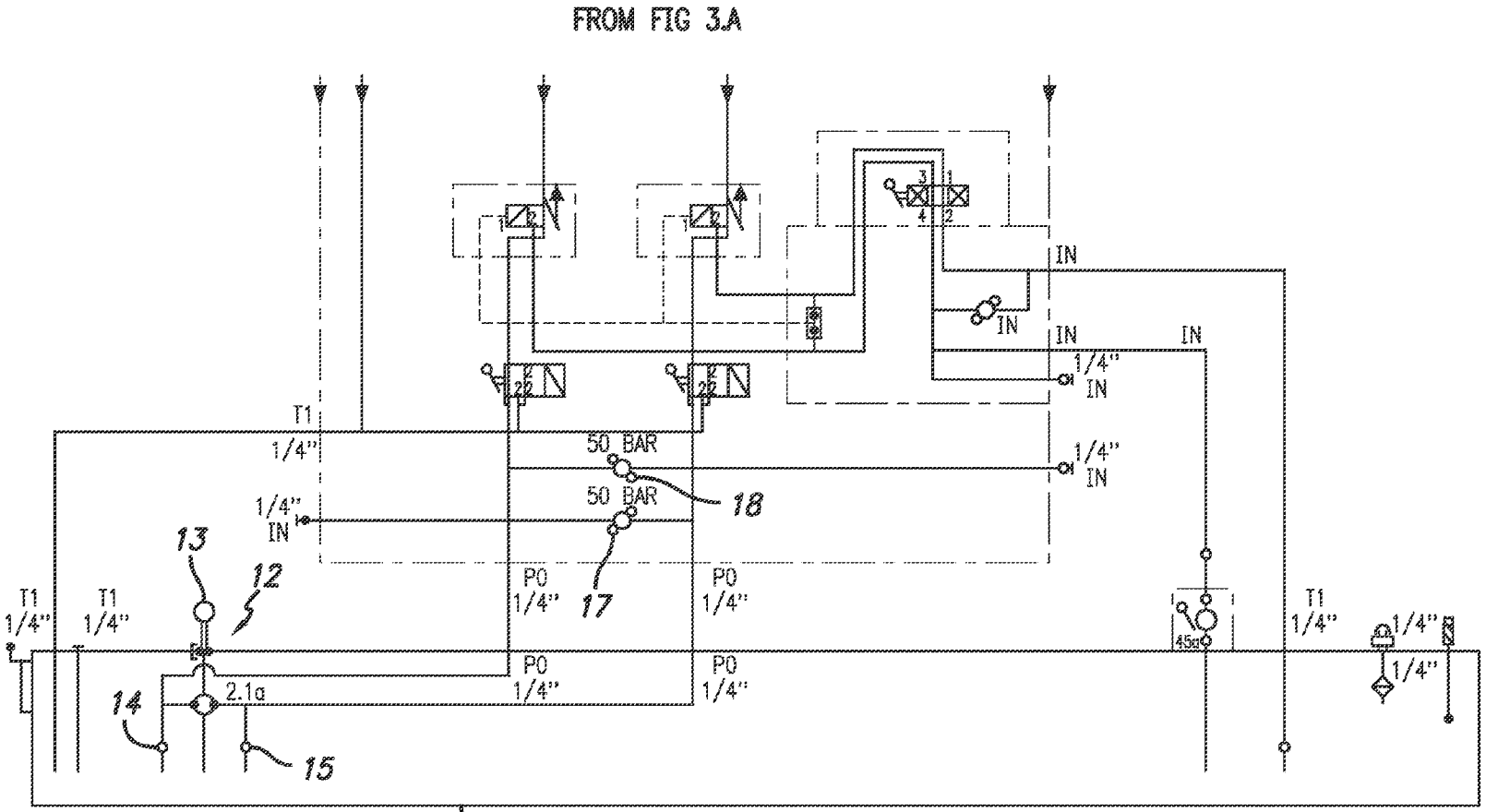

In order to allow the point blades to alternately move from one position (be it normal or reverse) to the other, the hydraulic oil actuators are configured as two opposed hydraulic oil linear cylinders or more simply as a double acting cylinder, such as the one denoted by 1 in FIGS. 3A-3B.

The general construction of the points in the several switch machines according to prior art is described in more detail in European Patent EP712772. The description of such patent is not to be considered as limiting the present invention, but only as the description of an example of known art available to the person skilled in the art.

Unlike several known solutions providing the hydraulic oil fluid to be supplied to a distribution reservoir wherein said hydraulic oil fluid is stored at the operating pressure, the hydraulic control unit according to the present disclosure is directly connected to the actuators controlling the movement of the point blades, as shown in FIGS. 3A-3B, where the hydraulic circuit of the control unit is shown.

An hydraulic oil double-acting actuator 1 of a switch machine is connected by its inlets to two lines 10, 11 of a hydraulic circuit supplying a hydraulic oil fluid. A pump 12, driven by an electric motor 13, draws through its delivery ends/outlets 14, 15 from an hydraulic oil fluid reservoir 16.

The pump is reversible. In other words, reversing the rotational direction causes the hydraulic oil fluid flow direction to be reversed. Therefore, the delivery end becomes the outlet and the outlet becomes the delivery end. As a consequence, reversing the hydraulic oil fluid flow in the circuit causes, in one case, the fluid to be supplied to one of the two chambers separated by the piston 101, thus translating the piston in a first direction. When the operating direction of the pump is reversed, and the fluid flow direction is consequently reversed, the fluid is supplied to the chamber at the side opposite to the previous one of the piston. Therefore, the piston moves in the opposite direction. As a consequence, the two lines 10 and 11 of the circuit alternately act as the delivery line and as the return line at the same time.

In the hydraulic oil fluid supply circuit, in each one of the lines a pressure reducing valve for the fluid can be provided in case a maximum pressure value 17, 18 is exceeded.

The direction of the hydraulic oil fluid flow is reversed by reversing the rotational direction of the driving electric motor 13. As noted below in additional detail, this is achieved by a combination of switches which are driven contemporaneously with the point blades A1 and A2 reaching the end position and which switch the power supply circuit of the motor to stop its operation in the rotational direction of the stroke end and to supply the motor power signal such that the motor performs an opposite stroke with respect to the previous one when it is operated again. Contemporaneously with such action, when the end position of the point blades A1 and A2 is reached, monitoring switches are operated causing a control signal to be generated, which signal is detected in the cabinet from where the signal driving the switch machine comes from, that is the power signal operating the pump motor.

From each one of the two lines 10 and 11 of the circuit supplying the hydraulic oil fluid to the actuator 1 moving the point blades, a branch 20, 21 supplying/returning the hydraulic oil fluid to hydraulic timing means denoted by 23 comes out, which timing means define a length of time based on the change of operating physical parameters of the hydraulic circuit and, in particular, based on the supplied volume of the pressurized hydraulic oil fluid.

In order to properly set the time measurement on the basis of the change in the hydraulic oil fluid volume, that is the volume of the fluid supplied during the operating step of the pump 12, flow rate regulators are provided in the two branches. Moreover, valves 25 are provided in the branches 20 and 21 for setting a fluid pressure threshold below which valves remain closed and prevent the fluid from being supplied to the timing cylinder. This minimum pressure for supplying the timing cylinder is set at a value slightly lower than the one set in pressure reducing valves 17, 18 in the delivery/return lines 10, 11 leading to the actuator 1 moving the point blades.

Means for measuring the time on the basis of the supplied fluid volume can comprise a double-acting cylinder 23. The two branches 20, 21 are each connected to one of two chambers of the cylinder provided at opposite sides of the piston 123.

When the pump is driven, the hydraulic oil fluid is supplied into one of the two lines 10 or 11 depending on the rotational direction of the driving motor 13 and on the corresponding operating direction of the pump 12. Such fluid is supplied both to the actuator moving the point blades 1 and, once a specific pressure is reached, to the timing cylinder.

Similarly to the actuator moving the point blades, depending on the operating direction of the pump 12, the piston 123 of the timing cylinder moves in one direction or in the opposite one. Since the cylinder volume (i.e., the length and the diameter) is fixed, the stroke of the piston is a constant value too and it always exactly corresponds to the same amount of hydraulic oil fluid, namely the same volume of said fluid that has to be supplied to the timing cylinder.

By setting the flow rate of the fluid supplied to the timing cylinder 23 by means of flow rate regulators 24 and a predetermined threshold pressure opening the valves 25, it is possible to set the operating modes of the timing cylinder. The adjustable valves 25 open when the fluid pressure reaches the predetermined threshold pressure value. The timing cylinder is supplied at a pressure greater than or equal to the threshold value set in valves 25 and at a pressure lower than or equal to that set in maximum pressure reducing valves 17 and 18. When the pressure overcomes the value set in valves 25 and the latter open, the piston makes its stroke between two predetermined positions within a given time, which is predetermined and dependent on said settings. Therefore, the piston can act as a hydraulic timing member for controlling the operations of adjusting and monitoring the operating steps of the control unit 4. In addition, if the pressure drops under the value set in the valves 25, the valves close, so that the movement of the piston and thus the timing are stopped. When the pressure exceeds again the value set in the valves 25, the valves open again and the piston recovers its stroke, thus restarting the timing function.

With the timing cylinder as a double-acting one, an operating rod 223 is associated to the piston which drives (directly or through a transmission) the control members 26, 27, 28 and 29 of one or more switches which in this case serve for several functions such as, in particular, for breaking/reversing the power signal to the motor 13 and generating monitoring signals when the point blades A1 and A2 reach the end positions.

With further reference to FIGS. 3A-3B, reference numerals 110 and 111 denote an additional delivery/return line and a further return/delivery line respectively of the hydraulic oil fluid circulation circuit, which lines 110, 111 are intended to be connected to an additional switching actuator of the railway point. The additional actuator can be, for example, an intermediate actuator like those denoted by 2 in FIG. 1 or an actuator for the points frog like those denoted by 3, 3' in FIG. 1.

In accordance with a further embodiment, the additional lines 110 and 111 are provided with pressure reducing valves denoted by 117 and 118 which reduce the pressure of the fluid operating the further actuators to a value different than that provided in lines 10 and 11 connected to the double-acting actuator 101.

Figure 4:
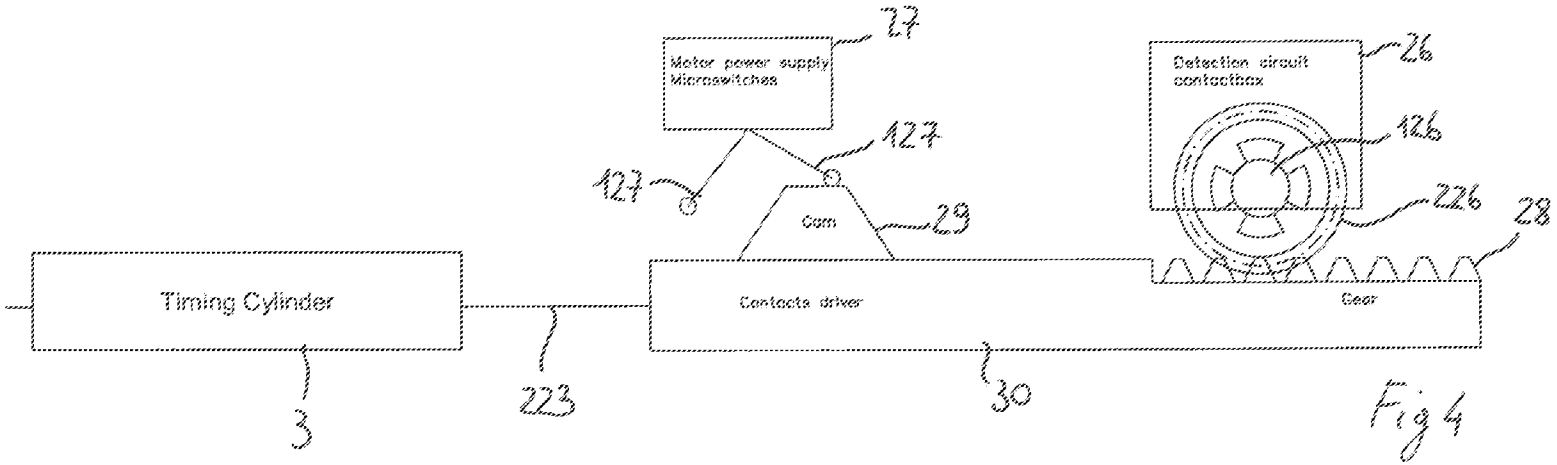
FIG. 4 and FIG. 5 schematically show one of two positions of the piston of a timing cylinder and of the control rack switching the contacts stopping and reversing the polarity of the power supply of the electric motor driving a pump of the hydraulic control unit, as well as contacts monitoring that the point blades have reached the proper switching end position.
Figure 5:
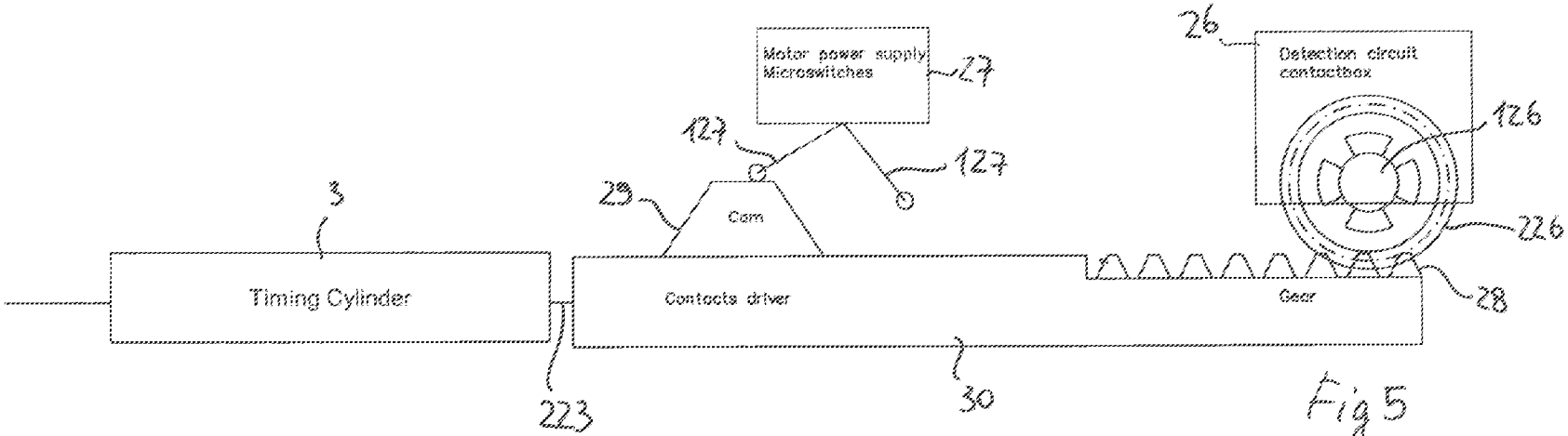

FIGS. 4 and 5 schematically show an example of the control members 28, 29.

The arrangement is shown schematically, since the specific implementation is within the range of the average person skilled in the art, in particular for the control members 28 and for the control multipolar switch 26, which are described in EP712772 as well, which is incorporated herein by reference in its entirety.

In the schematic arrangement of FIGS. 4 and 5, the timing cylinder 23 has a rod 223 directly connected to a slide 30 bearing a cam 29, in particular a trapezoidal cam, and a rack 28. The two control members cam 29 and rack 28 do not have to be necessarily provided on the same slide or in any other arrangement where they are not independent from each other.

The control multipolar switch 26 has a spindle 126 by means of which the movement of the contacts is operated in the several switching positions and upon which spindle a gearwheel 226 is fitted engaging the rack 28. The movement of the piston causes the rack to be moved and the switching condition of the contacts of the control multipolar switch to be changed.

The switch 27 comprises control members, such as levers or buttons 127 cooperating with the cam 29 having such a profile that the movement of the slide upon which the switch is fitted causes the switching condition of said switch 27 to be changed upon the movement of the rod 223 of the timing cylinder 23 by means of which the power supply to the motor 13 is broken and the power signal to the motor is reversed, preparing the motor to be driven to perform the operation opposite to the previous one.

FIGS. 4 and 5 show the timing cylinder 23 and the rod 223 as well as the slide with control members 28 and 29 of the switches 26 and 27 in the normal and reverse condition of the points respectively, that is with the piston 123 of the timing cylinder 23 in the corresponding end positions inside the cylinder.

Switches 26, 27 (and therefore the functions determined by the several switching conditions thereof) are controlled within time periods defined by the timing cylinder 23. Such time periods depend on and are adjustable for example by acting on the flow rate regulating means 24 in the branches 20 and 21 supplying the timing cylinder.

According to an embodiment not shown in the figures, control members 28, 29 can be connected to the rod 223 of the timing cylinder 23 by means of a transmission, which transmission can change with respect to the rate according to predetermined ratios or in a continuous way, such to modify the length of the time periods necessary for taking the switches 26 and 27 from a switching condition to a second switching condition.

It is also possible to provide several independent transmissions for the control members 28 of the switch 26 and for the control members 29 of the switch 27.

It should be noted that the mechanical solution described here to modify the length of the interval of time with respect to the fixed interval of the timing cylinder can be provided also in combination with the hydraulic solution providing the flow rate in the branches 20 and 21 to be changed by means of fluid flow rate regulating means 24.

Such adjustments can be useful, for example, to allow optimization of the operating conditions under several extreme weather conditions that therefore drastically modify the characteristics of the hydraulic oil fluid, or for maintenance adjustments.

The arrangement of the control unit described above allows a switch machine to be supplied and operated according to the modes described below:

Operating Sequence

Under normal operating conditions the sequence of events that can occur is:

Power is supplied by the Cabinet 5

Point blades A1 and A2 are moved the electric control is acquired by means of the timing cylinder 23, the control members 28 and the control multipolar switch 26;

the electrical circuit supplying and switching the power supply of the electric motor is broken for operating the bidirectional pump (with reference to the flowing direction of the hydraulic oil fluid) in the direction opposite to the previous one when the motor is operated again. This occurs by means of the timing cylinder 23, the switch 27, and the control members 29 thereof.

The contacts of the switch 26 can be "sliding" contacts integral with the position of the mechanical members moving with the slide and the cam 29. Such contacts, being engaged in suitable seats, associate the circuit configuration to the reaching of the End of Operation condition for a Normal/Reverse position. The switch 26 operated by the timing cylinder 23 causes the monitoring circuit to be closed/opened consistently with the operation set by the Cabinet. Such consistency is obtained by mechanical members transmitting the motion from the timing Cylinder to the switch.

After switching the contacts of the monitoring switch 26, the contacts of the operating switch 27 are operated. Such sequence allows completion of the operation. If the motor power supply is broken before acquiring the control, the operation could not be completed due to lack of power.

According to a further operating mode, operating steps occurring after a command from the Cabinet and after the control unit being consequently operated will be described below considering the Normal positioning condition of point blades A1 and A2 and of the actuator to which the control unit is connected at the beginning of the operation.

Step 0

Point blades in Normal position.

Cabinet: does not supply power.

Delivery and return lines of the hydraulic oil circuit are at the same pressure.

Control contacts are configured for the Normal position.

Operating contacts by means of which the motor is operated such to move the point blades in the Normal position break the Motor power supply circuit, while the operating contacts by means of which the motor is power supplied in the driving direction for the movement operation from the normal condition to the reverse condition allow the motor to be power supplied.

The timing cylinder is not operating and the control members of monitoring and operating switches are in position.

The counter indicates the number of operations performed.

Step 1

Operating command from Normal to Reverse

The Cabinet supplies power.

The hydraulic oil control unit starts to pressurize the oil in the delivery line.

Monitoring contacts are configured for the Normal position.

Operating contacts by means of which the motor is operated such to move the point blades in the Normal position break the Motor power supply circuit, while the operating contacts by means of which the motor is power supplied in the driving direction for the movement operation from the normal condition to the reverse condition allow the motor to be power supplied.

The timing cylinder is not operating and the control members of monitoring and operating switches are in position.

The counter indicates the number of operations performed.

Step 2

Operating command from Normal to Reverse, adjustment pressure of the Sequence.

The Cabinet: supplies power.

The control unit provides to flow hydraulic oil fluid.

The control unit supplies hydraulic oil fluid to the actuator moving the point blades.

Monitoring contacts are configured for the Normal position

Operating contacts by means of which the motor is operated such to move the point blades in the Normal position break the Motor power supply circuit, while the operating contacts by means of which the motor is power supplied in the driving direction for the movement operation from the normal condition to the reverse condition allow the motor to be power supplied.

The piston and the rod of the timing cylinder begin to translate.

Control members of the monitoring and operating switches are operated.

The counter indicates the number of operations performed.

Step 3

Operating command from Normal to Reverse, adjustment pressure.

Cabinet: supplies power

The control unit supplies oil-hydraulic fluid to the actuator moving the point blades.

In the hydraulic oil control unit the oil flows from the delivery line directly to the return line due to the pressure relief by the pressure reducing valve in delivery/return lines 10, 11.

Monitoring contacts are configured for the Normal position.

Operating contacts by means of which the motor is operated such to move the point blades in the Normal position break the Motor power supply circuit, while the operating contacts by means of which the motor is power supplied in the driving direction for the movement operation from the normal condition to the reverse condition allow the motor to be power supplied.

The piston and the rod of the cylinder continue to translate.

Control members of the monitoring and operating switches are operated.

The counter indicates the number of operations performed.

Step 4

Reverse position is reached.

Cabinet: no power is supplied.

The control unit does not supply hydraulic oil fluid to the actuator moving the point blades.

Monitoring contacts are configured for the Reverse position (event preceding the operating Contacts being switched).

Operating contacts by means of which the motor has been operated such to move the point blades in the Reverse position break the Motor power supply circuit, while the operating contacts by means of which the motor is power supplied in the driving direction for the movement operation from the reverse condition to the normal condition allow the motor to be power supplied (event following the control Contacts being switched).

The translation of the piston and of the rod of the timing Cylinder is stopped.

Control members of the monitoring switches and of the operating switches take the corresponding position.

The counter adds 1 to the number of operations performed.

Step 5

Points in the reverse position

The Cabinet does not supply power.

The delivery and return lines of the hydraulic oil circuit are at the same pressure.

Monitoring contacts are configured for the Reverse position.

Operating contacts by means of which the motor has been operated such to move the point blades in the Reverse position break the Motor power supply circuit, while the operating contacts by means of which the motor is power supplied in the driving direction for the movement operation from the reverse condition to the normal condition allow the motor to be power supplied.

The timing cylinder is not operating.

The control members of the monitoring switches and of the operating switches take the corresponding position.

The counter adds 1 to the number of operations performed.

Step 6

Operating command from Reverse to Normal

The Cabinet: provides power supply.

The hydraulic oil control unit starts to pressurize the oil in the delivery line.

Monitoring contacts are configured for the Reverse position.

Operating contacts by means of which the motor has been operated such to move the point blades in the Reverse position break the Motor power supply circuit, while the operating contacts by means of which the motor is power supplied in the driving direction for the movement operation from the reverse condition to the normal condition allow the motor to be power supplied.

The timing cylinder is not operating.

The control members of the monitoring switches and of the operating switches take the corresponding position.

The counter indicates the number of operations performed.

Step 7

Operating command from Reverse to Normal, adjusting pressure of the Sequence.

The Cabinet supplies power.

The control unit provides the hydraulic oil fluid to be circulated.

The control unit supplies oil-hydraulic fluid to the actuator moving the point blades.

Monitoring contacts are configured for the Reverse position.

Operating contacts by means of which the motor has been operated such to move the point blades in the Reverse position break the Motor power supply circuit, while the operating contacts by means of which the motor is power supplied in the driving direction for the operation moving from the reverse condition to the normal condition allow the motor to be power supplied.

The piston and the rod of the timing cylinder begin to translate.

Control members of the monitoring and operating switches are operated.

The counter indicates the number of operations performed.

Step 8

Operating command from Reverse to Normal, adjustment pressure.

The Cabinet supplies power.

The control unit supplies hydraulic oil fluid to the actuator moving the point blades.

In the hydraulic oil control unit the oil flows from the delivery line directly to the return line due to the pressure relief by the pressure reducing valve in delivery/return lines 10, 11.

Monitoring contacts are configured for the Reverse position.

Operating contacts by means of which the motor has been operated such to move the point blades in the Reverse position break the Motor power supply circuit, while the operating contacts by means of which the motor is power supplied in the driving direction for the movement operation from the reverse condition to the normal condition allow the motor to be power supplied.

The piston and the rod of the cylinder continue to translate.

Control members of the monitoring and operating switches are operated.

The counter indicates the number of operations performed.

Step 9

Normal position is reached.

The Cabinet does not supply power.

The control unit does not supply hydraulic oil fluid to the actuator moving the point blades.

Monitoring contacts are configured for the Normal position (event preceding the operating Contacts being switched).

Operating contacts by means of which the motor has been operated such to move the point blades in the normal position break the Motor power supply circuit, while the operating contacts by means of which the motor is power supplied in the driving direction for the movement operation from the normal condition to the reverse condition allow the motor to be power supplied (event following the control Contacts being switched).

The timing cylinder is not operating.

Control members of the monitoring switches and of the operating switches take the corresponding position.

The counter indicates the number of operations performed +2.

In case of incomplete movement, the control unit is in the condition with the timing cylinder in the intermediate position, with the monitoring contacts not switched and with operating contacts still arranged for the started but not completed operation. In this condition, the operation has to be started again to allow the control unit to reach the End of Operation condition. If starting the operation again does not allow the electrical control on the control unit to be acquired, this is a situation where the control unit or external Interfaces could have been subjected to failures. The incomplete movement can be detected in case of external events acting on the interface to the Cabinet, the non-transmission of electrical (operating or monitoring) signals causes the overall railway points system not to acquire the control. The incomplete movement can be detected in case of external events, such as obstacles or obstructions, which causes the pressure operating the pressure limiting devices to be reached earlier than expected causing the control unit to make its operation. In such case the overall railway points system does not acquire the electrical control. In case of leakages due to ruptures or similar failures, it is possible for the control unit not to reach the End of Operation condition and therefore the event is detected due to the non-acquisition of the electrical control by the control unit and by the overall railway points system.

In case of a movement slower than expected due to failures (for example leakages) of the control unit or failures of the actuator, the timeout provided by the Cabinet can act by breaking the power supply before acquiring the electrical control. Therefore, the event is detected due to the non-acquisition of the electrical control. In this case, starting again the operation can allow the control unit to achieve its Mission but the failure, if any, is detected by direct inspection.

A number of embodiments of the disclosure have been described. Nevertheless, it will be understood that various modifications can be made without departing from the spirit and scope of the present disclosure. Accordingly, other embodiments are within the scope of the following claims.

The invention claimed is:

1. A hydraulic oil control unit for supplying hydraulic oil actuators in switch machines of a railway point, comprising a closed circulation circuit of a hydraulic oil fluid, wherein at least one circulation pump is provided, with a delivery end of the pump being connected to a delivery line and an intake end of the pump being connected to a return line of the circulation circuit of said fluid, wherein the delivery and return lines of the circulation circuit are connected to at least one hydraulic oil actuator, the at least one actuator controlling movement of point blades of the railway point and translating said point blades by moving said point blades from a normal end position to a reverse end position or vice versa;

electrical means for functionally monitoring the movement of the point blades and/or monitoring reaching the end position the point blades have been moved to;

a timing cylinder for stopping an actuating stroke of said at least one actuator moving the point blades when one of the end positions has been reached and/or after a predetermined operating time of said at least one actuator, and means for switching a direction of the actuating stroke, by reversing a circulation direction of the hydraulic oil fluid to the at least one actuator translating the point blades in order to operate the at least one actuator in the opposite direction, wherein:

the timing cylinder is a hydraulic timing cylinder distinct from the at least one actuator, the hydraulic timing cylinder detecting changes in flow parameters in the closed circulation circuit and, on the basis of said changes, operating one or more electrical switches breaking a power supply of an electrical motor driving the circulation pump, and the hydraulic timing cylinder detect said changes on the basis of hydraulic oil fluid supplied by the circulation pump to the hydraulic timing cylinder.

2. The control unit according to claim 1, wherein the hydraulic oil fluid is supplied to the hydraulic timing cylinder through a valve allowing fluid passage when the fluid reaches a certain pressure.

3. The control unit according to claim 1, wherein the hydraulic timing cylinder comprises a cylinder/piston assembly connected to the delivery line of the hydraulic oil circuit for supplying the actuator moving the point blades and mechanical means controlling electrical switches constituting the electrical means for functionally monitoring the movement of the point blades and/or monitoring reaching the end position, the electrical means for switching the movement direction of point blades and the electrical means breaking the power supply circuit of the motor of the pump.

4. The control unit according to claim 3, wherein the timing cylinder is a double-acting timing cylinder, one of the delivery and return lines of the hydraulic oil circulation circuit supplying the actuator moving the point blades being connected thereto, that is one of the intake/delivery ports of the pump.

5. The control unit according to claim 4, wherein each inlet/outlet of the cylinder/piston assembly of the timing cylinder is connected to the corresponding delivery and return line of the circulation circuit supplying the hydraulic oil fluid by means of an automatic valve with a shutter movable in an open condition by hydraulic oil fluid pressure.

6. The control unit according to claim 1, wherein the hydraulic timing cylinder comprises a cylinder/piston assembly mechanically connected, directly or by a transmission, to a mechanical control member switching the electrical contacts.

7. The control unit according to claim 6, wherein at least part of the electrical contacts is provided in circuits generating signals monitoring the functional condition and monitoring that the point blades have reached the end position and at least part of the electrical contacts is part of a circuit supplying/reversing the power supply signal of the motor.

8. The control unit according to claim 1, further comprising means for changing the intervals of time of the operation of actuators moving the point blades.

9. The control unit according to claim 8, wherein the hydraulic timing cylinder comprises a cylinder/piston assembly mechanically connected by a transmission to a mechanical control member switching the electrical contacts, said transmission having an adjustable inlet stroke to outlet stroke ratio.

10. The control unit according to claim 8, further comprising flow rate regulators in the branches connecting the delivery and return lines of the hydraulic oil circulation circuit supplying the actuator moving the point blades to the cylinder/piston assembly of the timing cylinder, said regulators being variable flow rate regulators.

11. The control unit according to claim 1, further comprising automatic pressure relief valves for the hydraulic oil fluid when said hydraulic oil fluid reaches a predetermined maximum pressure.

12. The control unit according to claim 1, wherein the circulation circuit comprises at least one additional delivery line and at least a corresponding additional return line for controlling an additional switching actuator.

13. The control unit according to claim 1, further comprising pressure limiting devices set at such a pressure that the hydraulic oil fluid is supplied at a different pressure in each additional pair of delivery and return lines, which pressure is intended for controlling the actuator connected thereto with respect to the pressure of the first pair of delivery and return lines.

14. A hydraulic oil control unit for supplying hydraulic oil actuators in switch machines of a railway point, comprising a closed circulation circuit of a hydraulic oil fluid, wherein at least one circulation pump is provided, with a delivery end and an intake end connected to a delivery line and a return line respectively of the circulation circuit of said fluid, wherein the delivery and return lines of the circulation circuit are connected to at least one hydraulic oil actuator, the at least one actuator controlling movement of point blades of the railway point and translating said point blades, by moving said point blades from a normal end position to a reverse end position and vice versa, an additional switching actuator distinct from the at least one actuator, and at least one additional delivery line and at least one corresponding additional return line for controlling the additional switching actuator.

15. A method for controlling an hydraulic oil system moving point blades in a railway points or the like for moving said point blades between a normal end position and a reverse end position or vice versa, comprising setting a predetermined interval of time for moving point blades from the normal end position and the reverse end position or vice versa;

operating hydraulic oil means moving the point blades by supplying a pressurized hydraulic oil fluid for moving the point blades from the normal end position to the reverse end position or vice versa;

measuring the interval of time during which the pressurized hydraulic oil fluid is supplied at a set pressure level for moving the point blades;

stopping supply of the pressurized hydraulic oil fluid when the length of time of the measured interval of time is equal to that of the predetermined interval of time;

and preparing the hydraulic oil fluid supplying circuit to reverse the direction of the hydraulic oil fluid flow for operating hydraulic oil means moving the point blades in the reverse direction, to move the point blades in a reverse manner;

wherein the interval of time during which the pressurized hydraulic oil fluid is supplied at a set pressure level is hydraulically measured by detecting, independently from the hydraulic oil means, the volume of the hydraulic oil fluid supplied by the pump to the hydraulic oil means.

16. The method according to claim 15, wherein the volume of the hydraulic oil fluid supplied by the pump to the hydraulic oil means is detected by a unit distinct from the hydraulic oil means, the unit transforming the change in the hydraulic oil fluid volume into a mechanical motion controlling switching means/switches stopping and/or reversing the supply of the pressurized hydraulic oil fluid flow.

17. The control unit according to claim 1, wherein the circulation pump is a reversible circulation pump, the electrical means switching the direction of the actuating stroke comprise switches reversing a power supply signal of the electric motor driving the pump in order to reverse a rotational direction of said motor and of said pump, the electrical means being driven when the point blades reach the end position to generate said reversing of the circulation direction of the hydraulic oil fluid flow in the circulation circuit.

18. The control unit according to claim 1, wherein the hydraulic timing means further operate, on the basis of said changes, one or more of i) the means for switching the direction of the actuating stroke, and ii) the electrical means for functionally monitoring the movement of the point blades and/or monitoring reaching the end position the point blades have been moved to.

* * * * *